US007627968B2

(12) United States Patent
Lin

(10) Patent No.: US 7,627,968 B2
(45) Date of Patent: Dec. 8, 2009

(54) SLEEVE WITH INDICATION ASSEMBLY

(76) Inventor: Yu-Chun Lin, 235 Chung-Ho Box 8-24, Taipei (TW)

( * ) Notice: Subject to any disclaimer, the term of this patent is extended or adjusted under 35 U.S.C. 154(b) by 158 days.

(21) Appl. No.: 11/447,749

(22) Filed: Jun. 7, 2006

(65) Prior Publication Data

US 2006/0280572 A1 Dec. 14, 2006

(30) Foreign Application Priority Data

Jun. 9, 2005 (TW) ..... 94215291 U

(51) Int. Cl.
*G09F 3/00* (2006.01)

(52) U.S. Cl. ..... 40/306; 40/913

(58) Field of Classification Search ..... 40/306, 40/913; 411/13–14; 81/176.1, 121.1, DIG. 5; 205/323

See application file for complete search history.

(56) References Cited

U.S. PATENT DOCUMENTS 1,853,255 A * 4/1932 Borden ..... 279/110
2,982,040 A * 5/1961 Keller ..... 40/306
3,658,662 A * 4/1972 Casson et al. ..... 205/323
4,165,242 A * 8/1979 Kelly et al. ..... 148/246
4,982,627 A * 1/1991 Johnson ..... 81/121.1
5,031,488 A * 7/1991 Zumeta ..... 81/180.1
5,511,917 A * 4/1996 Dickson ..... 411/439
5,664,921 A * 9/1997 Leslie ..... 411/427
6,073,552 A * 6/2000 Cruse et al. ..... 101/32
6,095,739 A * 8/2000 Albertson et al. ..... 411/439
6,695,558 B2 * 2/2004 Shibata ..... 411/439
7,021,878 B1 * 4/2006 Albertson et al. ..... 411/439
7,296,370 B2 * 11/2007 McDaniel et al. ..... 40/27.5
2002/0187019 A1 * 12/2002 Campbell et al. ..... 411/439
2004/0067120 A1 * 4/2004 Speer ..... 411/14
2004/0126201 A1 * 7/2004 Kobylinski et al. ..... 411/13

* cited by examiner

*Primary Examiner*—William L. Miller
(74) *Attorney, Agent, or Firm*—Egbert Law Offices PLLC

(57) ABSTRACT

A sleeve with an indication assembly comprises a sleeve; and a toggle having an inner diameter corresponding to an outer diameter of the sleeve; and the toggle being made of aluminum alloy; a surfaces of the toggle being anodic processed so as to form with a protection film of different colors; thus the surfaces of the toggle is prevented from cracking, collision, mist and falling off. Furthermore, in another case, the toggle has an inner diameter corresponding to an outer diameter of the sleeve; and the toggle is made of iron. A surface of the toggle is electroplated so as to form with a copper layer and then is performed with anodic processing so as to have the effect of indication of sizes.

4 Claims, 4 Drawing Sheets

SLEEVE WITH INDICATION ASSEMBLY

FIELD OF THE INVENTION

The present invention relates to sleeves with indications, in particular to a sleeve with an indication assembly, wherein a toggle is rotatably engaged to a sleeve. The indication is printed on the surfaces of the toggle or the sleeve by laser printing. The indication can be seen easily and be retained for a very longer time.

BACKGROUND OF THE INVENTION

Currently, there are various kinds of studs, nuts, and spanners with different sizes. To be carried out easily and conveniently, sleeves of different sizes for suiting a D head spanner are developed.

In one prior art, each sleeve formed with two annular recesses. A nose is formed between the two annular recesses. An annular color strip is formed on the nose. The strip is protected by a protection film or a metal ink.

Furthermore, in another prior art, a periphery of a sleeve is formed with a slide stop recess and then a convex texture is formed by rolling process as an indication. A color layer is coated upon a surface of the indication. Then the indication is ground and electroplated.

In above mentioned methods, a color layer is coated upon the sleeve. Then the color layer is coated with a protection film or is electroplated. Normally, the surface of the sleeve is difficult to be cracked or is affected by wetness so that the color strip is wet or the protecting film is destroyed, or the electroplated layer is rusted so that the indications are lose of function. Thereby the above mentioned prior art is not a permanent way for retaining the indications on the sleeve.

Thereby there is an eager demand for a novel way which can improve the prior art defects so that the indication can be retained on the sleeve permanently without being affected by wetness, cracking or collision.

SUMMARY OF THE INVENTION

Accordingly, the primary object of the present invention is to provide a sleeve with an indication assembly, wherein a toggle is rotatably engaged to a sleeve. The indication is printed on the surfaces of the toggle or the sleeve by laser printing. The indication can be seen easily and be retained for a very longer time.

To achieve above objects, the present invention provides a sleeve with an indication assembly which comprises a sleeve; and a toggle having an inner diameter corresponding to an outer diameter of the sleeve; and the toggle being made of aluminum alloy; a surfaces of the toggle being anodic processed so as to form with a protection film of different colors; thus the surfaces of the toggle is prevented from cracking, collision, blur and falling off. Furthermore, in another case, the toggle has an inner diameter corresponding to an outer diameter of the sleeve; and the toggle is made of iron. A surface of the toggle is electroplated so as to form with a copper layer and then is performed with anodic processing so as to have the effect of indication of sizes.

The various objects and advantages of the present invention will be more readily understood from the following detailed description when read in conjunction with the appended drawing.

BRIEF DESCRIPTION OF THE DRAWINGS

FIGS. 2-1, 2-2, and 2-3 are schematic views showing the second embodiment of the present invention.

FIGS. 3-1, 3-2, and 3-3 are schematic views showing the third embodiment of the present invention.

FIGS. 4-1, and 4-2 are schematic views showing the fourth embodiment of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
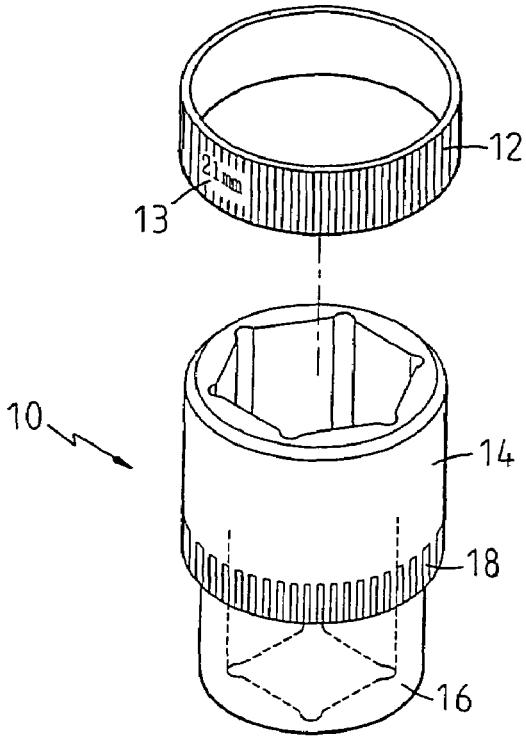
FIGS. 1-1, 1-2, and 1-3 are schematic views showing the first embodiment of the present invention.

Referring to FIG. 1, the structure of the present invention is illustrated. The present invention has the following elements.

A sleeve 10 and a toggle 12 are made of aluminum alloy, iron, or other metals, which are performed by chemical or electrochemical anodic processing so that a surfaces of the aluminum is formed with a film containing metal. The thickness of the film is about 6μ to 15μ. The feature is that the surfaces of the sleeve 10 and toggle 12 are formed with bright and wear-endurable metal. The metal is oxidized with low chemical activity so as to protect the metal therein. The surfaces may be selected to be bright surfaces or mist surfaces. The surfaces are porous surfaces and have preferred permeation. Thus, the surfaces can be sunk in organic or inorganic dyes or sublimed so as to have beautiful patterns. The dyes will permeate into the holes in the surfaces. Furthermore, when the sleeve 10 and toggle 12 are made of iron, they can be electroplated with a copper bottom layer. Then the sleeve 10 and toggle 12 are performed with anodic processing so as to have a desired quality. Then the size of the sleeve 10 and the toggle 12 after anodic processing are printed with size indications by laser printing. The printing can be retained well without disappear.

Referring to FIG. 1, the sleeve 10 has a large cylinder 14 and a small cylinder 16. An outer periphery of the large cylinder 14 has a trench portion 18. After anodic processing, the toggle 12 can be sleeved around the large cylinder 14. This is the first embodiment of the present invention.

Figures 1, 2:
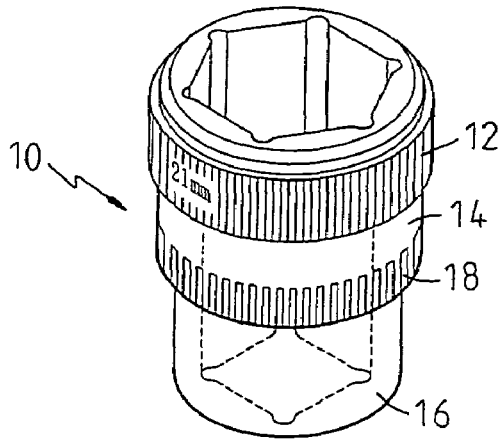

Referring to FIG. 2, the second embodiment of the present invention is illustrated. In the following those identical to the first embodiment will not be described herein. Only those difference are described. In this embodiment, an upper side of the large cylinder 14 is formed with an annular recess 17 for receiving the toggle 12. The toggle 12 is rotatable around a center of the large cylinder 14. Thus the indication on the toggle 12 is movable.

Figures 1, 2, 3:
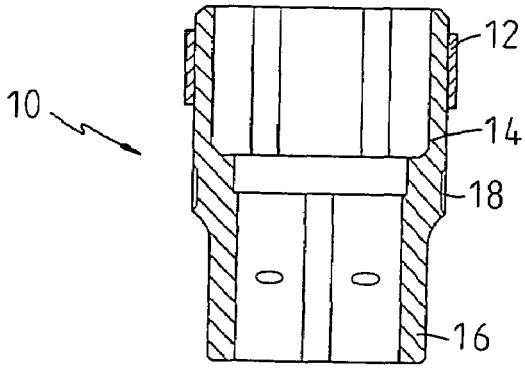
Figures 1, 2:
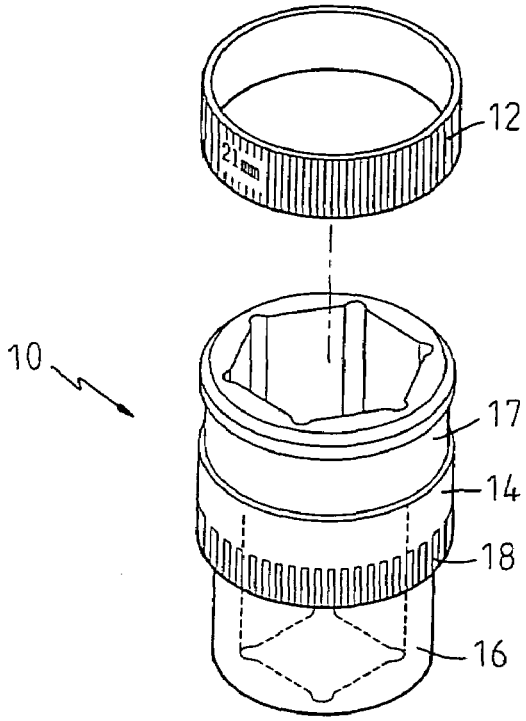
Figure 2:
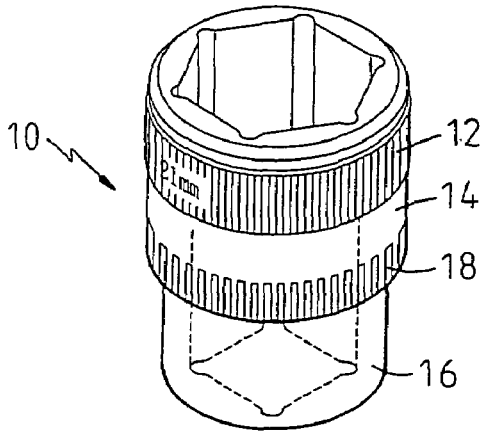
Figures 2, 3:
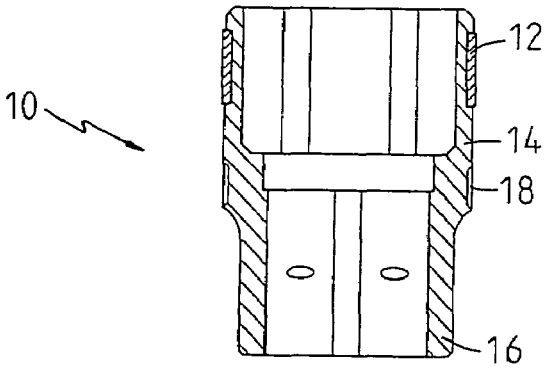
Figures 1, 3:
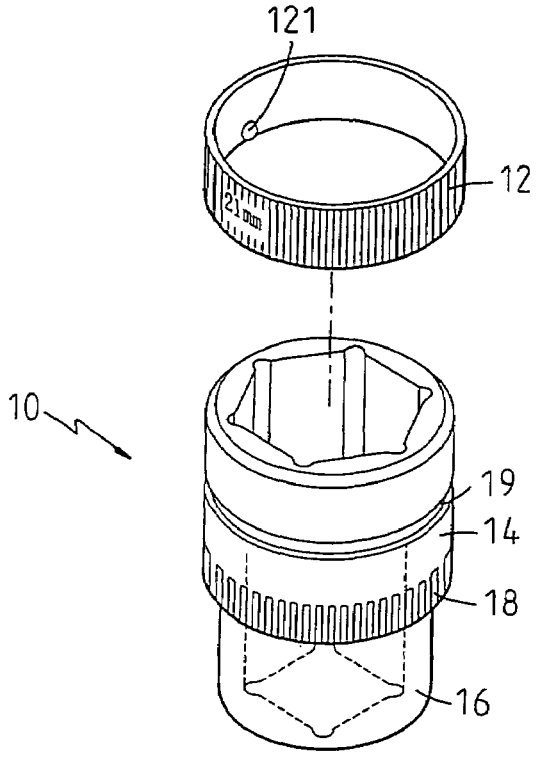
Figures 2, 3:
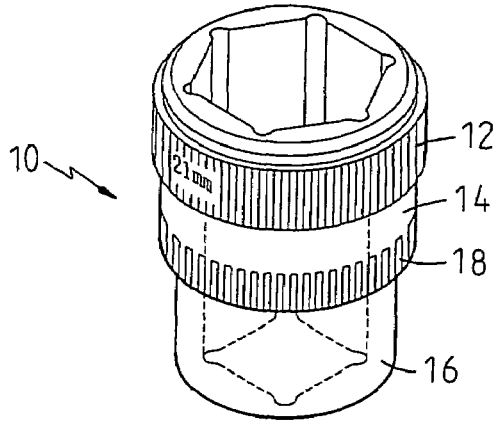
Figure 3:
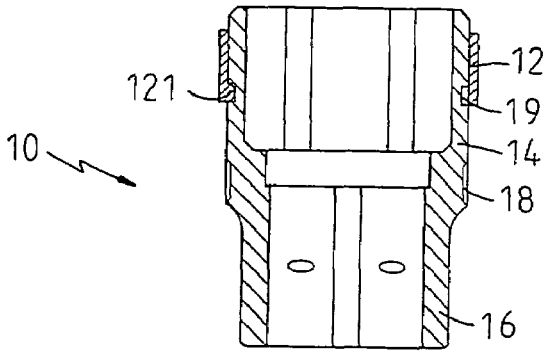

Referring to FIG. 3, the third embodiment of the present invention is illustrated. In the following those identical to the first embodiment will not be described herein. Only those difference are described. An inner lower side of the toggle 12 has a nose 121. The large cylinder 14 has a narrow annular recess 19 for receiving the nose 121. Thereby the annular recess 19 is as a track and the toggle 12 is rotatable along the track. Thus the indication on the toggle 12 is movable.

Figures 1, 4:
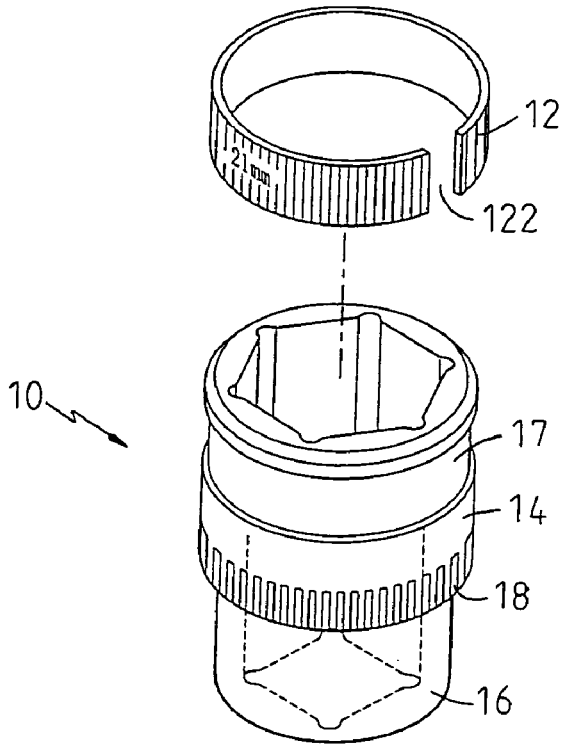
Figures 2, 4:
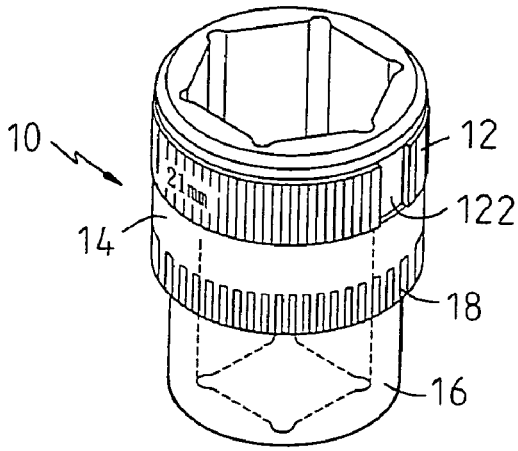

Referring to FIG. 4, the fourth embodiment of the present invention is illustrated. In the following those identical to the first embodiment will not be described herein. Only those difference are described. The large cylinder 14 has an annular recess 17 and the toggle 12 is formed as a C ring with an opening 122. The toggle 12 is rotatably received in the annular recess 17. The user can drive the toggle 12 to move by moving the sides of the opening 122 of the toggle 12.

Thereby in the present invention, by the annular recess 17 and the narrow annular recess 19, the toggle 12 is rotatable. The surface of the toggle 12 has performed with anodic processing. Thus the indication portion 13 will not be cracked or destroyed. Moreover, the anodic processing makes the present invention being made with fewer time and the present invention provides various indications to users.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An indicator assembly comprising:

a sleeve comprised of a first cylindrical member and a second cylindrical member, said sleeve having a longitudinal axis and an aperture extending therealong for receiving a tool; and a toggle having an aperture extending therethrough and defining an inner diameter of said toggle which is fixed to an outer diameter of said sleeve, said toggle being of aluminum alloy, said toggle having a surface with size indicia of said sleeve thereon, said surface having a protective film formed by anodic processing and such that said surface of said toggle is protected from cracking and against collision.

2. The indicator assembly of claim 1, wherein said sleeve has a surface machined with textures or patterns, said surface of said toggle being machined with textures and patterns.

3. The indicator assembly of claim 1, wherein said toggle fixedly engages said sleeve at said first cylindrical member.

4. The indicator assembly of claim 1, wherein said toggle is a closed loop ring.

* * * * *